US005428375A

United States Patent [19]

Simon et al.

[11] Patent Number: 5,428,375

[45] Date of Patent: Jun. 27, 1995

[54] MULTIPLE PRINT HEAD INK JET PRINTER

[76] Inventors: Robert J. Simon, 3333 Vanquil Trail, West Carrolton, Ohio 45449; Richard J. Ratermann, 9094 Mary Haynes Dr., Centerville, Ohio 45458

[21] Appl. No.: 890,214

[22] Filed: May 29, 1992

[51] Int. Cl.[6] ..... B41J 2/145

[52] U.S. Cl. ..... 347/12

[58] Field of Search ..... 400/82; 346/76 PH, 140 R

[56] References Cited

U.S. PATENT DOCUMENTS

| | | | |
|---|---|---|---|
| 4,375,923 | 3/1983 | Hidaka et al. | 400/82 |
| 4,940,998 | 7/1990 | Asakawa | 346/140 R |
| 4,999,647 | 3/1991 | Wood et al. | 346/75 |

FOREIGN PATENT DOCUMENTS

| | | | |
|---|---|---|---|
| 2226394 | 12/1973 | Germany | 400/82 |
| 0127174 | 7/1985 | Japan | 400/82 |
| 0232977 | 11/1985 | Japan | 400/82 |
| 0231952 | 9/1988 | Japan | 400/82 |

*Primary Examiner*—Benjamin R. Fuller
*Assistant Examiner*—N. Le

[57] ABSTRACT

An ink jet printer for printing in a wide format includes a plurality of ink jet print heads for producing rows of regularly spaced apart ink jets. The print heads are supported and located by first and second print head carriages that are controllably moveable to locate the print heads to within a fraction of an ink jet spacing in directions both parallel with and perpendicular to the direction of movement of the print medium. The first and second carriages are spaced apart along the direction of relative movement of the print medium by a distance sufficient to permit the first and second print heads to be arranged in an interleaved relation, or an end to end relation.

10 Claims, 4 Drawing Sheets

MULTIPLE PRINT HEAD INK JET PRINTER

FIELD OF THE INVENTION

The present invention relates to continuous ink jet printers and most particularly to such printers for high speed printing of page wide information.

BACKGROUND OF THE INVENTION

Wide format, low resolution, high volume ink jet printers capable of producing print widths up to 13 inches wide at a resolution of 120 dpi have been available since the mid-1970s. See for example, the Kodak HSPS 2900 TM ink jet printing system available from Eastman Kodak Co., Rochester, N.Y.

Recently, long array, high resolution, continuous ink jet print heads have been developed capable of producing a column of print 4 inches wide at a resolution of 240 dpi, see for example, U.S. Pat. No. 4,999,647 issued Mar. 12, 1991 to Wood, et al.

To date, a high volume, high resolution, (greater than 200 dpi) wide format (greater than 12 inches) ink jet printer has not been available.

SUMMARY OF THE INVENTION

It is the object of the present invention to provide an improved wide format ink jet printer. The object is achieved according to the present invention by an ink jet printer having first and second ink jet print heads for producing rows of regularly spaced apart ink jets. The print heads are supported and located by first and second print head carriages that are controllably movable to locate the print heads to within a fraction of an ink jet spacing in directions both parallel with and perpendicular to the direction of movement of the print medium. The first and second carriages are spaced apart along the direction of relative movement of the print medium by a distance sufficient to permit the first and second print heads to be arranged in an interleaved relation, or in an end to end relation.

The present invention is advantageous in that a plurality of high resolution print heads can be arranged in end to end relation to provide a high resolution wide format ink jet printer. Alternatively, the plurality of ink jet print heads may be arranged in interleaved relation to double the resolution of the printer.

MODES OF CARRYING OUT THE INVENTION

Figure 1:
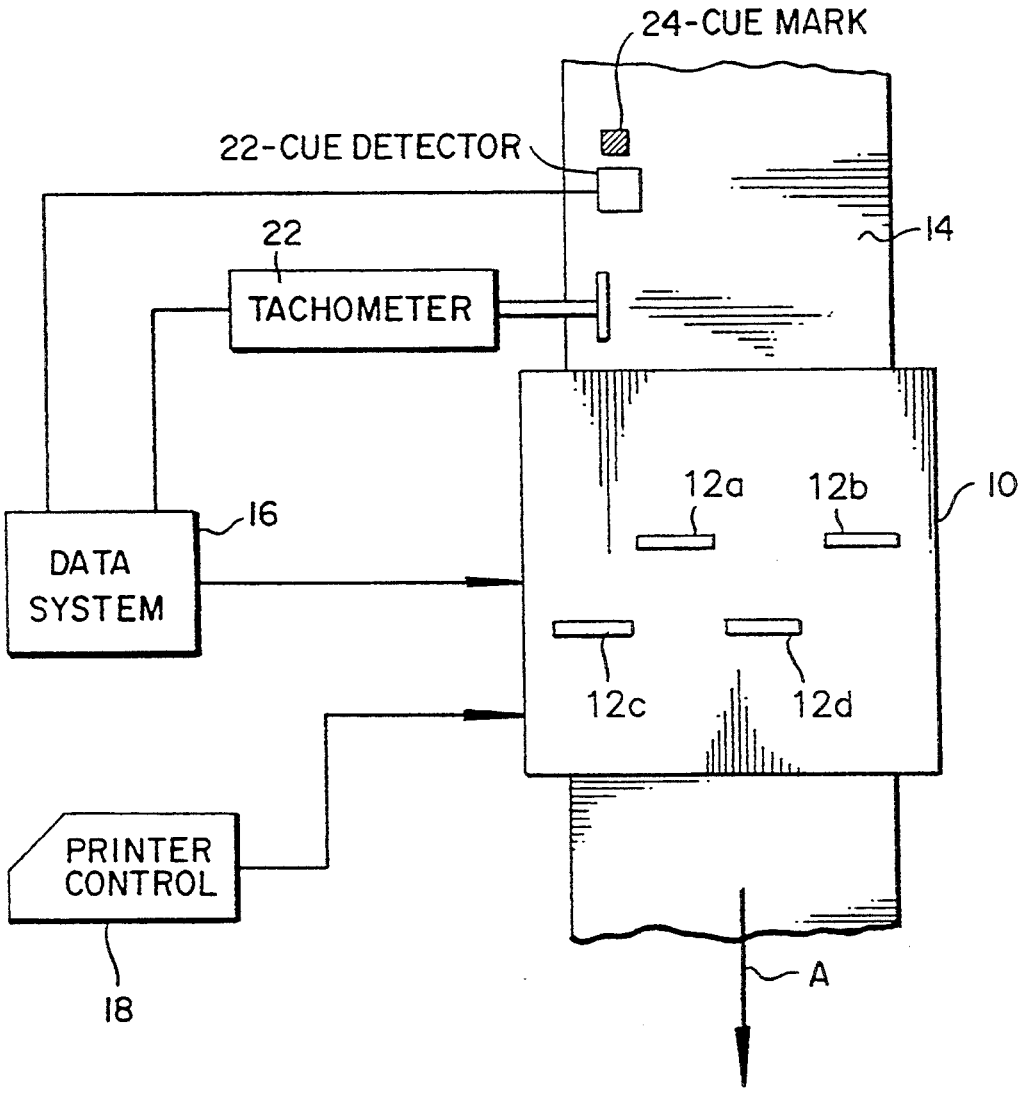
FIG. 1 is a schematic diagram showing an ink jet printing system according to the present invention.

Referring now to FIG. 1, an ink jet printing system according to the present invention is shown. The ink jet printing system includes an ink jet printer 10 having a plurality of ink jet print heads 12*a–d* arranged to print on a print medium 14 that is moved relative to the printer 10 in the direction of arrow A. The ink jet printing system includes a data system 16 that supplies printing signals to the ink jet print heads 12 and a printer control system 18 that controls the relative location of the print heads 12 in the ink jet printer 10. The ink jet printing system may also include a tachometer 20 for monitoring the motion of the medium 14 and supplying a tach signal to the data system 16 to coordinate the print signals with motion of the medium 14 as is known in the art. The ink jet printing system may further include a cue detector 22 for detecting a cue mark 24 that is pre-printed on medium 14. The cue detector 22 produces a cue detect signal that is supplied to the data system 16 to coordinate the printing of information on the medium 14. Such an arrangement is employed for example when the medium 14 is a pre-printed form, and the ink jet printing system is employed to fill out information on the form.

Figure 2:
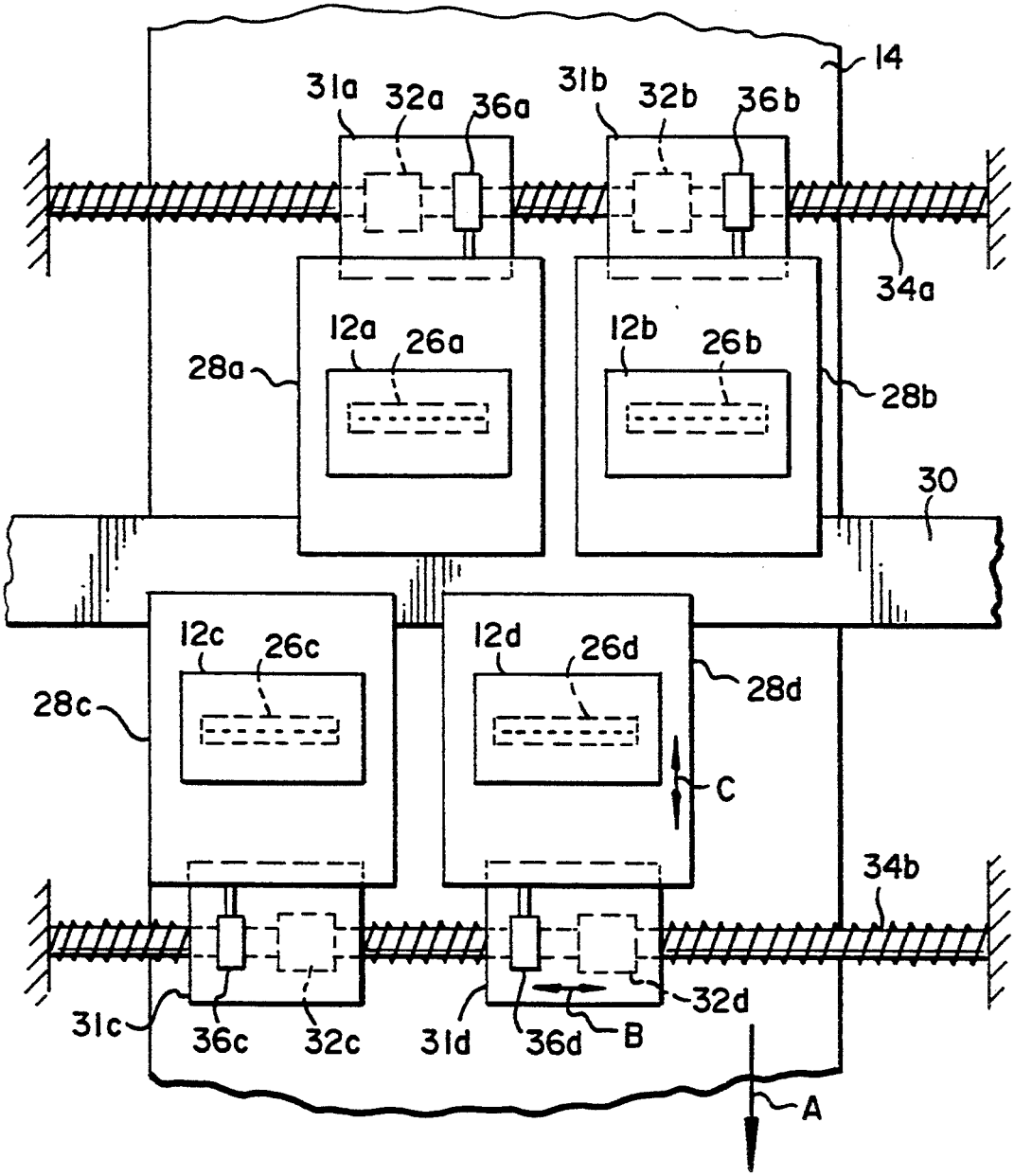
FIG. 2 is a schematic diagram of a multiple print head carriage assembly employed with the present invention.

Turning now to FIG. 2, the ink jet printer 10 is shown in more detail. The ink jet printer includes, for example, four print heads 12*a–d* of the type described in above cited U.S. Pat. No. 4,999,647. It will be apparent that more than four print heads can be provided according to the present invention. Each print head 12 is capable of producing a row of regularly spaced ink jets 26*a–d*, four inches long, and 240 jets per inch. Each print head 12 is supported by and located in a print head carriage 28*a–d*. The print head carriages 28 are supported for sliding movement on one end by a center rail 30 and on an opposite end by an X platform 31*a–d*. Each X platform 31 carries an X translation actuator 32*a–d*, for moving the X-platform 31 along fixed lead screws 34*a* and *b* in a direction B perpendicular to the motion of the medium 14. Each X platform 31 also carries a Y translation actuator 36*a–d* that is coupled to the respective carriage 28 for moving the carriage 28 in a direction C parallel with the direction of motion of the medium 14.

The X translation actuator 32 includes a stepper motor that turns a follower on lead screw 34 to drive carriage 30. The follower is spring loaded to eliminate backlash. The Y translation actuator 36 includes a stepper motor that drives a plunger back and forth. Each carriage 28 is spring biased toward a corresponding X platform 31 into contact with the Y-translation actuator 36. Both X and Y actuators 32 and 36 are controllable, one step at a time, and each step represents respective movements of $\frac{1}{8}$ of an ink jet spacing.

Figure 3:
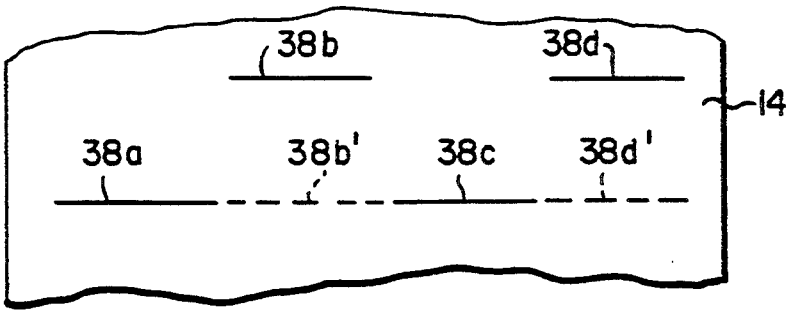
FIG. 3 is a diagram useful in describing the operation of the present invention.

FIG. 3 illustrates how a line of printing is produced across the width of the medium 14 by the print heads 12*a–d*. At any given instant, print head 12*a* is producing line portion 38*a* shown in FIG. 3, print head 12*b* is producing line portion 38*b*, etc. As described previously, the data system 16 (see FIG. 1) delays the signals to the respective Print heads so that the appropriate portions of the lines of print are produced across the medium 14. For example, the portions of the line of printing labeled 38*b'* and 38*d'* would have been produced by print heads 12*b* and 12*d* at an appropriate earlier time to properly complete the line of printing with portions 38*a* and 38*c* as shown in FIG. 3. Adjustments to the location of the print head 12*a–d* are made with the Y actuators 36*a–d* so that the lines of print across the medium are perfectly aligned to within $\frac{1}{8}$ of an ink jet spacing, i.e. to within 0.0005 inches for an ink jet print head having 240 jets per inch.

The location or the ends of the line segments 38*a–d* in the direction parallel to the motion of the medium are adjusted with the X actuators. The X and Y actuators are adjusted by an operator from the printer control system 18 (see FIG. 1) until no visible artifacts can be seen in the output print.

The printer control system 18 is capable of adjusting the X and Y actuators by single steps (i.e. 0.0006 and 0.0005 inches at a time, respectively, at a slow speed of 25 steps per second, and at a high speed of 0.5 inches per second. The printer control system 18 is also capable of moving all four carriages in the X direction by the same amount at once, so that the line of printing can be centered on the medium 14.

Figure 4:
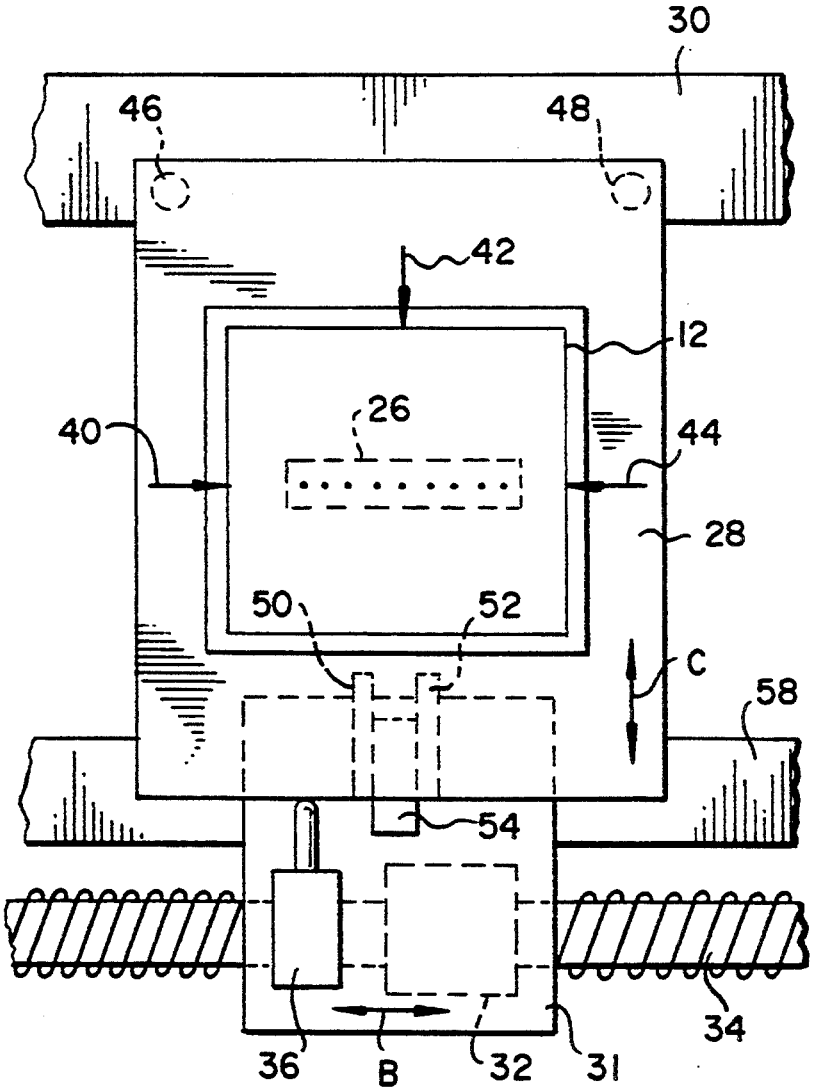
FIG. 4 is a top view of a single print head carriage employed in the present invention.

FIG. 4 is a top view of one of the print head carriages 28 in further detail. The print head 12 is supported in the carriage at three points indicated by arrows 40, 42 and 44, by cooperating alignment features in the print head and carriage. The alignment features at points 40 and 44 determine the orientation of the row of ink jets 26 in a direction perpendicular to the direction of the relative movement of the medium. The alignment feature at arrow 42 defines the orientation of the jets perpendicular to the surface of the medium by orienting the rotation of the print head about an axis passing through points 40 and 44. A pair of ball rollers 46, 48 are provided between the carriage 28 and the rail 30 to facilitate sliding of the carriage 28 on the rail 30. The alignment between the X platform 31 and the print head carriage 28 is maintained by a Y slide comprising a pair of rails 50 and 52 attached to the underside of the carriage 28 and a guide bar 54 attached to the X-platform 31. A spring 56 is connected between the print head carriage 28 and X-platform 31 and urges the carriage into contact with the Y actuator 36. The X-platform 31, in addition to being guided by the lead screw 34, is also supported by a rail 58 on which it slides.

Figure 5:
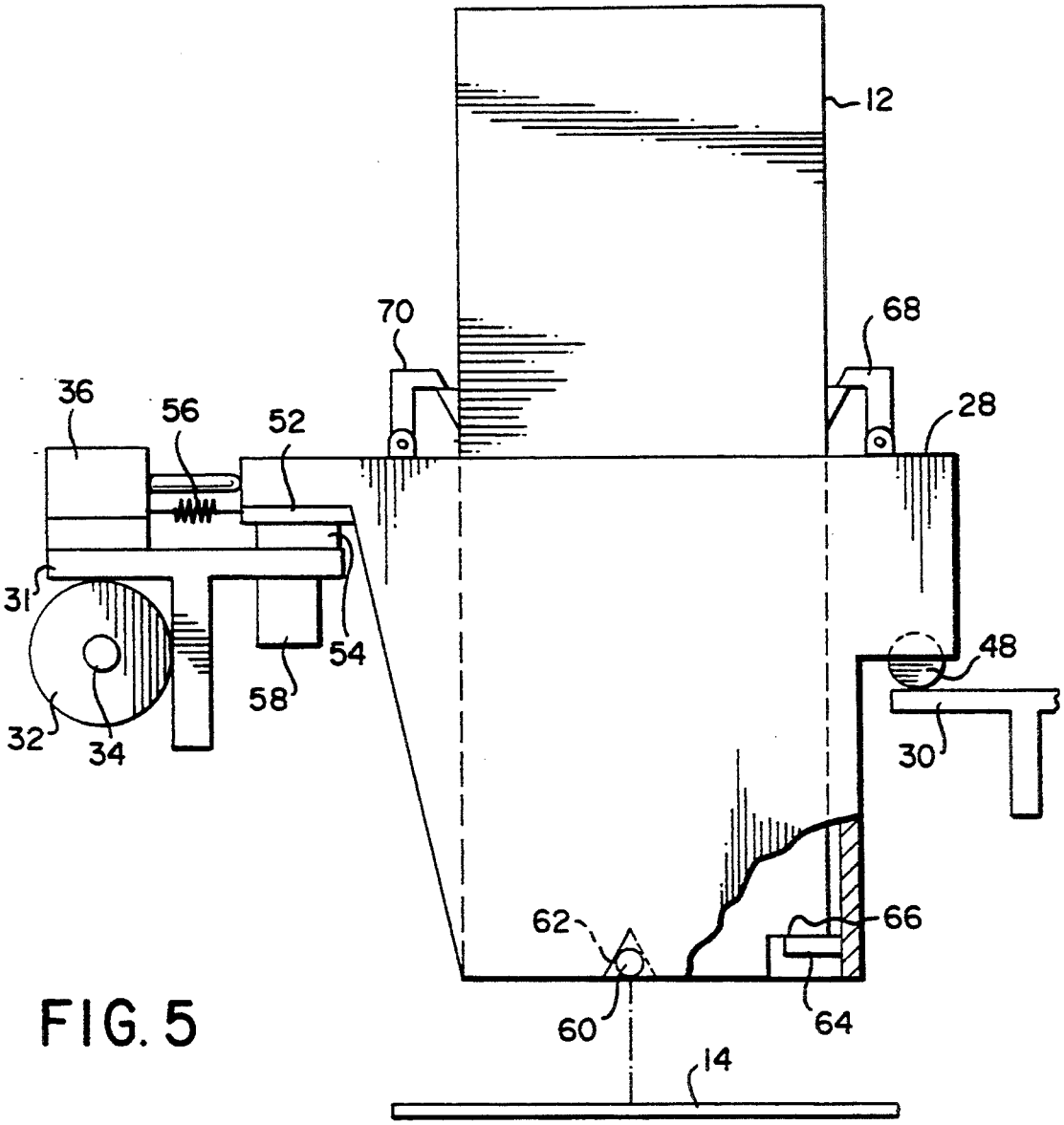
FIG. 5 is a side view of the print head carriage shown in FIG. 4.

FIG. 5 shows a side view of the print head 12 and carriage 28. As shown in FIG. 5, the alignment features at points 40 and 44 for aligning the print head 12 with carriage 28 each comprise an alignment pin 60 in carriage 28 that cooperates with an inverted V shaped slot 62 in the print head 12. The alignment features at point 42 comprise an alignment pin 64 that cooperates with a flat portion 66 on the print head 12. Hold down latches 68 and 70 are provided on the carriage 28 to hold print head 12 in the carriage and firmly seat it against the alignment features.

Figure 6:
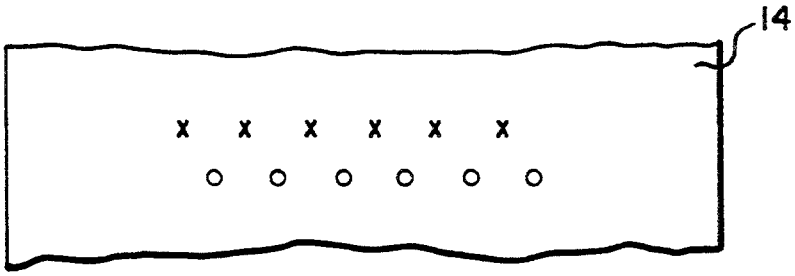
FIG. 6 is a schematic diagram useful in describing the operation of the present invention in an interlaced mode.

As shown in FIG. 2, the print heads 12*a–d* are arrayed to print a single line across the width of the medium 14. Alternatively, the pairs of print heads (e.g. 12*a* and *c*) may be positioned by printer control 18 so that the ink jets from one print head are interlaced with the ink jets of the other print head. FIG. 6 shows an example of interlace where the jets of say print head 12*a* are labeled with Xs and the jets of say print head 12*c* are labeled with 0s. The resulting print will have a horizontal resolution that is twice the resolution of the single print head. Similarly, different colors of ink can be supplied to the print heads 12*a–d* to provide spot color in an ink jet printer.

It will be apparent to one skilled in the art that the arrangement of print heads according to the invention can accommodate a larger number of print heads.

We claim:

1. An ink jet printer for printing an image on a print medium moving relative to the printer, comprising:

a. first and second ink jet print heads for producing rows of regularly spaced apart-ink jets; and b. first and second carriage means for supporting and locating said first and second ink jet print heads, respectively, in printing relation to said medium, said first and second carriage means being movable by translation actuators in directions parallel and perpendicular to a direction of relative movement of said print medium to within a fraction of an ink jet spacing and said first and second carriage means being spaced apart along the direction of relative movement of said print medium by a distance sufficient to permit said first and second print heads to be arranged so that an end of the first print head abuts an end of the second print head, to allow both print heads to print; and c. data system means for supplying print control signals to said first and second print heads, the print control signals to said first and second print heads being relatively delayed by an amount corresponding to the distance between said first and second print heads in the direction of movement of said medium.

2. The ink jet printer claimed in claim 1, further comprising printer control means for controlling the movement of said first and second carriage means.

3. The ink jet printer claimed in claim 1, further comprising means for detecting cue marks on the medium and producing a cue detect signal, and said data system being responsive to said cue detect signal to start printing.

4. The ink jet printer claimed in claim 1, wherein said first and second carriage means are movable to within $\frac{1}{8}$ of an ink jet spacing.

5. The ink jet printer claimed in claim 1, wherein said first and second print heads each produce rows of ink jets at least 4 inches long and having at least 240 jets per inch.

6. The ink jet printer claimed in claim 1, wherein said first and second carriage means are mounted for movement on first and second lead screws arranged perpendicular to the direction of relative movement of the medium.

7. The ink jet printer claimed in claim 6, wherein said lead screws are fixed and wherein said first and second carriage means further include motorized follower means for cooperating with said fixed lead screws to provide movement of said carriages.

8. The ink jet printer claimed in claim 1, wherein said first and second carriage means and said first and second print heads include cooperating locating features to locate such print heads such that rows of ink jets are perpendicular to the direction of relative movement of said print medium, and said ink jets are perpendicular to a surface of said print medium.

9. The ink jet printer claimed in claim 1, wherein said translation actuators comprise stepper motors for turning a follower on a lead screw to drive said first and second carriage means.

10. The ink jet printer claimed in claim 1, wherein said print heads arrangement comprises an interleaved relation.

* * * * *